US005226346A

United States Patent [19]

Wagner et al.

[11] Patent Number: 5,226,346

[45] Date of Patent: Jul. 13, 1993

[54] AXIAL PISTON TYPE PRESSURE MEDIUM SERVOMOTOR CONTROL DEVICE

[75] Inventors: Gerhard Wagner, Remseck; Frank Tietze, Stuttgart; Ludger Kortenjann, Filderstadt; Rainer Wüst, Stuttgart, all of Fed. Rep. of Germany

[73] Assignee: Mercedes-Benz AG, Fed. Rep. of Germany

[21] Appl. No.: 889,265

[22] Filed: May 28, 1992

[30] Foreign Application Priority Data

May 30, 1991 [DE] Fed. Rep. of Germany ..... 4117735

[51] Int. Cl.[5] ..... F15B 13/02; F15B 15/22

[52] U.S. Cl. ..... 91/51; 91/408; 91/465

[58] Field of Search ..... 91/47, 48, 51, 31, 6, 91/407, 408, 409, 464, 463, 465, 466, 394

[56] References Cited

U.S. PATENT DOCUMENTS

| | | | |
|---|---|---|---|
| 3,068,849 | 12/1962 | Thorner | 91/464 |
| 3,312,146 | 4/1967 | Quere et al. . | |
| 3,548,876 | 12/1970 | Viersma | 91/51 X |
| 3,645,167 | 2/1972 | Espenschied et al. | 91/48 X |
| 4,044,653 | 8/1977 | Aoki | 91/48 X |
| 4,046,060 | 9/1977 | Becker et al. | 91/463 X |

FOREIGN PATENT DOCUMENTS

| | | | |
|---|---|---|---|
| 712340 | 10/1941 | Fed. Rep. of Germany . | |
| 1397486 | 3/1965 | France . | |
| 143412 | 10/1953 | Sweden | 91/31 |
| 0821767 | 4/1981 | U.S.S.R. | 91/48 |
| 0985483 | 12/1982 | U.S.S.R. | 91/48 |
| 256652 | 3/1927 | United Kingdom | 91/6 |

*Primary Examiner*—Edward K. Look
*Assistant Examiner*—Hoang Nguyen
*Attorney, Agent, or Firm*—Evenson, McKeown, Edwards & Lenahan

[57] ABSTRACT

An axial piston-type servomotor uses control connections on the working cylinder and corresponding control edges on the working piston, together with selector valve apparatus for controlling the working piston into a central stroke position.

7 Claims, 1 Drawing Sheet

AXIAL PISTON TYPE PRESSURE MEDIUM SERVOMOTOR CONTROL DEVICE

BACKGROUND AND SUMMARY OF THE INVENTION

The present invention concerns a control device for a pressure medium servomotor of the axial piston type, and, more particularly, to a control device which positions an axial piston of a servomotor in a central stroke position both simply and reliably.

In a known control device for a servomotor driven by compressed air as shown in FR-PS 13 97 486, two central position control connections are located at a greater distance from one another than the control edges. Thus, in the central stroke position of the working piston, the control connections are each connected openly to an associated working pressure chamber. The two central position control connections are connected via a selector shut-off valve to an intrinsically closed expansion vessel such that, in the central stroke position of the working piston, the working pressure chamber connected to the pressure source is connected openly to the expansion vessel, whereas the other working pressure chamber is shut off relative to the selector shut-off valve. A catch must be used in order to be able to position the working piston in the central stroke position. This arrangement also has to fulfill a braking function for the working piston, in addition to the retention function in the unpressurized condition, because braking cannot be achieved by the working pressure alone. In this known device, it is also necessary to switch off the working pressure in good time on reaching the central stroke position before the expansion vessel is filled because otherwise the working piston starts moving again and leaves the central stroke position. An expansion vessel with an infinitely large volume or the relief of the associated pressure conduit to atmosphere would have the result that the working piston could no longer leave the central stroke position.

In another known control device for controlling a pressure medium servomotor of the axial piston type, as shown in DE-PS 712 340, two axially adjacent annular control chambers concentric with the piston axis are formed at the periphery of the working piston to position it in two different central stroke positions. Each control chamber is connected via a control hole in the working piston to the respective working pressure chamber adjacent to the other control chamber. Consequently, the configuration of the working piston and the pressure supply to the working cylinder are complicated, as is the configuration of the valve controlling the pressure supply.

Yet another type of control device for controlling the stroke position of a pressure medium servomotor of the axial piston type is shown in U.S. Pat. No. 3,312,146. The working piston is additionally fixed in its stroke central position by two auxiliary pistons which are respectively located in one of the two working pressure chambers through which the through piston rod of the working piston passes. The auxiliary pistons are located so as to be displaceable relative to both the working cylinder and relative to the working piston so that the working piston is supported on the working cylinder in its end-of-stroke positions by the respectively associated auxiliary piston (pressure-relieved by way of a 5/3-way control valve), whereas it is supported in its stroke central position by the auxiliary piston then subjected to pressure via the control valve. The other auxiliary piston located in the end-of-stroke positions in the respective working pressure chamber subjected to working pressure is in contact, decoupled from the working piston, with a housing stop fixing the stroke central position. A control edge on the auxiliary piston shuts off relative to its working pressure chamber the associated central position control connection of the working cylinder. This connection is continually connected to the pressure-relieved return conduit and bypasses the control valve. The auxiliary pistons increase the design complexity and reduce the useful stroke of the working piston and the useful cross-section of the working cylinder.

An object on which the present invention is to configure a device for controlling the hub position of a pressure medium servomotor such that a servomotor of the axial piston type driven by hydraulic working medium can be positioned in a central stroke position by simple but functionally reliable means.

This object has been achieved in an advantageous manner by an arrangement of the control edges of the working piston relative to the central position control connections such that, in the stroke central position of the working piston, both central position control connections are shut off or throttled relative to the working pressure chambers. The pressure conduit used as the return to the pressure-relieved reservoir is connected to the shut-off valve as the common pressure conduit leading to a pressure-medium vessel. In the first valve position of the shut-off valve, both central position control connections are connected to the pressure conduit used as the return. In the second valve position of the shut-off valve, both central position control connections are shut off relative to the pressure conduit used as the return. Selector valve apparatus are provided for the stroke central position, and these apparatus make it possible to connect both end position control connections synchronously to the pressure source.

The device according to the present invention is particularly characterized by a simple and functionally reliable control with respect to the approach to and retention of the stroke central position by the working piston. In the device according to the present invention, the two end position control connections are synchronously subjected to pressure while both central position control connections are opened to atmospheric pressure. If the working piston is located in one of the end-of-stroke positions, the pressurized oil supplied, via the end position control connection associated with the other end-of-stroke position, is led off via one or both central position control connections to the pressure-relieved return. Because of the resulting pressure difference in the two working pressure chambers acting on the working piston, the latter is displaced until it closes the two central position control connections by way of its control edges, and pressure equilibrium occurs at the working piston. The pressure forces of the two working pressure chambers hold the working piston in its stroke central position.

The throttle resistances located in the region of the control connections in the pressure conduits are matched for the stroke motions of the working piston between the three positions at which it can be located.

The pressure at the end position control connections can be switched off after an arbitrary period because of the catch arrangement on the working piston. This has the advantage that the complete gear-change control system is unpressurized and therefore has no leaks.

In the device according to the present invention, only three pressure conduits between the working cylinder and the selector valve have to be controlled because the two central position control connections can be connected by a common pressure conduit which leads to the selector valve. No special control chambers are thus necessary on the working piston to locate the stroke central position.

BRIEF DESCRIPTION OF THE DRAWINGS

These and further objects, features and advantages of the present invention will become more apparent from the following detailed description of currently preferred embodiments when taken in conjunction with the accompanying drawings wherein.

DETAILED DESCRIPTION OF THE DRAWINGS

Figure 1:
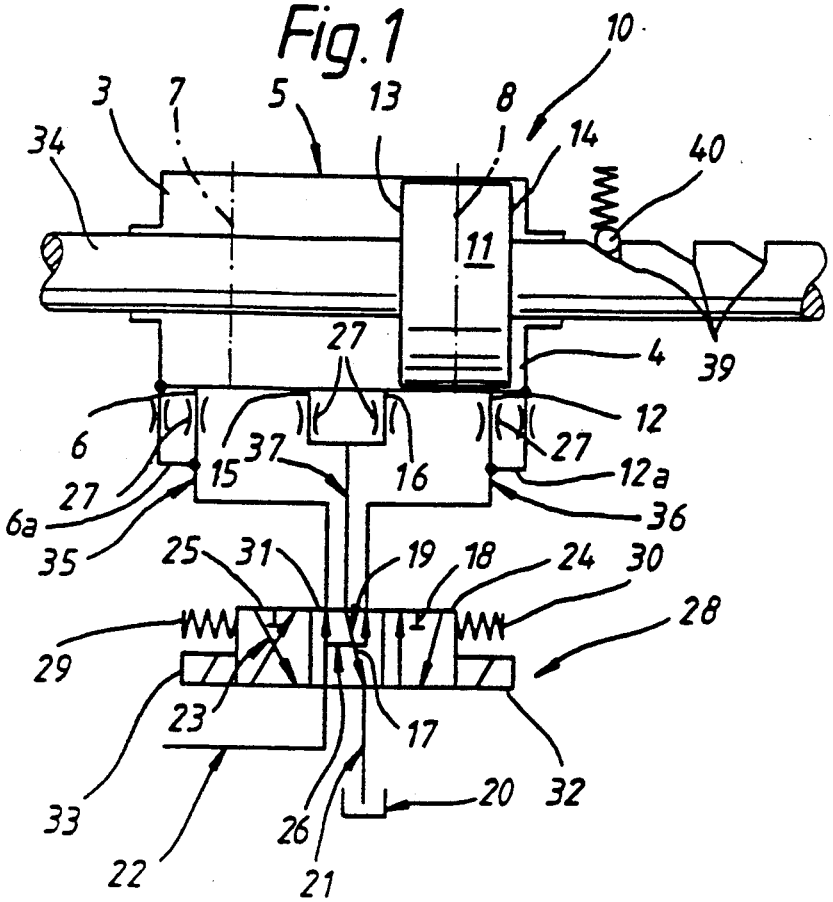
FIG. 1 is a hydraulic schematic circuit diagram of a first embodiment of a device according to the present invention.

A servomotor 10 of the axial piston type has a working cylinder 5 in which, in the conventional manner, a working piston 11 fastened to a through piston rod 34 is accommodated so that it can be axially displaced. The working piston 11 subdivides the cylinder internal space into two working pressure chambers 3, 4 and can be driven into two end-of-stroke positions 7 and 8 and into a stroke central position 9 by way of a 5/3-way valve 28.

In the region of the first end-of-stroke position 7, a first end position control connection 6 of the working cylinder 5 enters the working pressure chamber 3. This end position control connection 6 is shut off by an associated first control edge 13 at the periphery of the working piston 11 shortly before the working piston can make metallic contact with the relevant end of the cylinder. The first end position control connection 6 is connected to a valve connection of the 5/3-way valve 28 by a pressure conduit 35.

In the region of the second end-of-stroke position 8, a second end position control connection 12 of the working cylinder 5 enters the other working pressure chamber 4. This end position control connection 12 is shut off by an associated second control edge 14 at the periphery of the working piston 11 shortly before the working piston can make metallic contact with the relevant other end of the cylinder. The second end position control connection 12 is connected to a valve connection of the 5/3-way valve 28 by a pressure conduit 36.

In the region of the stroke central position 9, two central position control connections 15, 16 enter the internal space of the working cylinder 5. These central position control connections 15 and 16 are connected to a common pressure conduit 37 which leads to a valve connection of the 5/3-way valve 28. The two central position control connections 15, 16 are arranged relative to one another and also relative to the control edges 13, 14 such that the working piston 11 shuts off both central position control connections 15, 16 relative to the working pressure chambers 3, 4 in its stroke central position 9 but, when the working piston 11 is displaced out of the stroke central position 9, one of the two control connections 15 or 16 is connected to the respective expanding working pressure chamber even after a small stroke movement.

A throttle resistance 27 provided in the associated pressure conduit is located so as to exert its effect between each of the control connections 6, 12, 15 and 16, on one hand, and the 5/3-way valve 28, on the other.

Figure 2:
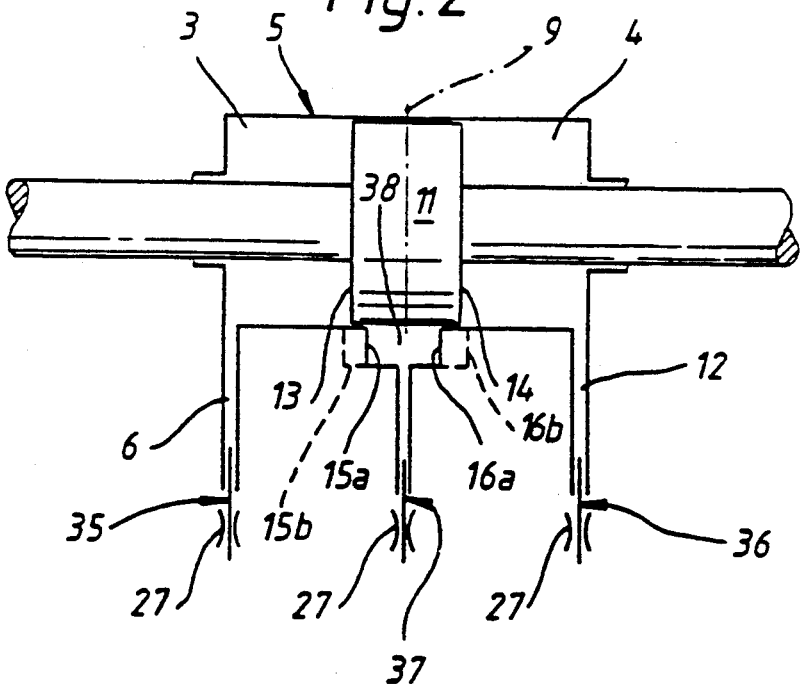
FIG. 2 is another embodiment of a servomotor of the present invention like that of FIG. 1 but with a variation of the configuration design of the central position control connections.

In the embodiment of FIG. 1, two individual connections 15, 16, each with a throttle resistance 27, are used for the central position control connections, whereas an axial control groove 38 on the inner wall of the working cylinder 5 is provided in the embodiment of FIG. 2. The two radial boundaries at the end of the axial control groove 38 interact, as control edges 15*a* and 16*a*, with the control edges 13 and 14 in the same way as the individual connections 15, 16 in FIG. 1. Otherwise, the embodiments of FIGS. 1 and 2 are identical.

The piston rod 34 is provided with a catch 39 for each of the piston positions 7 to 9 and a spring-loaded ball 40 engages in the catches 39. A return conduit 21 leading to a pressure-relieved reservoir 20 and a pressure conduit 32 supplied from a pressure source (not shown) are also connected to the 5/3-way valve 28. The 5/3-way valve 28 can be actuated by electromagnetic actuators 32, 33, respectively, into two valve positions 24 and 25 and by spring devices 29 and 30 into a central valve position 31.

A shut-off valve function in the form of an inner valve passage 19 is integrated into the 5/3-way valve 28. This valve passage 19 opens the common pressure conduit 37 of the central position control connections 15, 16 (FIG. 1) or 15*a*, 16*a* (FIG. 2) relative to the return conduit 21 in a first valve position 17 and shuts them off in a second valve position 18.

A selector valve function for the stroke central position 9 of the working piston 11 is also integrated into the 5/3-way valve 28 in the form of an inner valve passage 26 which, in a first valve position coinciding with the valve position 31 of the 5/3-way valve 28 produces an open connection between the pressure conduits 22, 35 and 36, i.e. the end position control connections 6 and 12 are connected to the pressure source. This selector valve function in the form of the valve passage 26 is, however, switched off in a still possible second valve position which is taken up by the valve passage 26 in the valve positions 24, 25 of the 5/3-way valve 28.

Finally, the usual selector valve function 23 for the two end-of-stroke positions of the working piston 11 is also integrated in the 5/3-way valve 28. In the first valve position 24 of the selector valve device 23 for the end-of-stroke position 8 selected by the electromagnetic actuator 32, the pressure conduit 22 of the pressure source is connected to the pressure conduit 35 of the working pressure chamber 3, and the return conduit 21 is connected to the pressure conduit 36 of the working pressure chamber 4. In the valve position 25 of the selector valve device 23 selected by the electromagnet 33, the pressure conduit 22 of the pressure source is connected with the pressure conduit 36 of the working pressure chamber 4, and the return conduit 21 is connected to the pressure conduit 35 of the working pressure chamber 3.

In the two last-mentioned valve positions 24, 25, the valve passage 19 (the shut-off function) is shut off (valve position 18), as well as the valve passage 26 (the stroke central position selection function).

The device according to the present invention operates as follows. When both electromagnets 32 and 33 are without current, the 5/3-way valve 28 is in its central valve position 31 due to the action of the spring means 29, 30. Because both end position control connections 6, 12 are connected to the pressure source (pressure conduit 22) and both central position control connections 15, 16 are connected to the return conduit 21, an equilibrium of pressure at the working piston 11 is established, and the working piston 11 is set to the stroke central position 9.

When one of the electromagnets 32, 33 is excited, the central position control connections 15 and 16 are shut off by the common pressure conduit 37, and the working piston 11 is driven in known manner into its appropriate end-of-stroke position 7 or 8 by the end position control connections 6 and 12.

If the working piston 11 is located in one of its end-of-stroke positions, for example in the end-of-stroke position 8 illustrated in FIG. 1, and the excitation of the associated electromagnet 32 is switched off, both end position control connections 6, 12 are connected to the pressure source (i.e., the pressure conduit 22), and both central position control connections 15, 16 are connected to the return conduit 21 as determined by the valve position 31. Thereby, the working pressure chamber 3 is also connected to the return conduit 21 at least via the one central position control connection 15 so that there is a pressure difference at the working piston 11 resulting from the higher pressure of the working pressure chamber 4 not connected to the return conduit 21 and the lower pressure of the working chamber 3. This pressure difference actuates the working piston 11 into the stroke central position 9.

The three valve functions 19 (shut-off), 23 (end position control) and 26 (stroke central position control) could also be achieved by separate selector valves if the resulting increase in control complexity is justifiable.

The end position control connections 6, 12 are each connected by a throttled bypass control connection **6*a*, 12*a* to the end of the associated working pressure chamber 3, 4, respectively, so as to make it possible to subject the working piston to pressure even in the end-of-stroke positions for return to the central position 9**.

A further embodiment is also shown in dotted lines in FIG. 2 in which, in the central position 9, the interacting control edge pairs **13/15*b* and 14/16*b* also permit a throttled connection between the respective working pressure chamber 3, 4, respectively, and the common pressure conduit 37**.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A device for controlling the stroke position of an axial piston-type pressure medium servomotor, comprising a working cylinder subdivided by a double-acting working piston into a first working pressure chamber and a second working pressure chamber, a first end position control connection provided on the working cylinder and entering the first working pressure chamber in a region of an associated first end-of-stroke position of the working piston, a second end piston control connection provided on the working cylinder and entering the second working pressure chamber in a region of an associated second end-of-stroke position of the working piston, a first control edge provided on the periphery of the working piston and located in the first working pressure chamber, a second control edge provided on periphery of the working piston and located in the second working pressure chamber, two axially spaced central position control connections provided on the working cylinder in a region of a stroke central position of the working piston, the control connections interacting with the respective control edges, a shut-off valve controllable between a first and a second valve position, via which the two central position control connections are connected, to a common pressure conduit leading to a respective working pressure chamber such that a central position control connection is connected to the pressure conduit in the first valve position of the shut-off valve and is shut off relative to the pressure conduit in the second valve position, a pressure source, a return pressure conduit connected to a pressure-relieved reservoir, selector valve means for the end-of-stroke positions of the working piston, to which selector valve means are connected the two end position control connections and the pressure source as well as the return pressure conduit, the selector valve means having a first selector position in which the first end position control connection is connected to the pressure source and the second end position control connection is connected to the return pressure conduit and a second selector position in which the first end position control connection is connected to the return pressure conduit and the second end position control connection is connected to the pressure source, wherein the control edges of the working piston are configured relative to the central position control connections such that, in the stroke central position of the working piston, both central position control connections are one of shut off and throttled relative to the working pressure chambers, the return pressure conduit to the pressure-relieved reservoir is connected to the shut-off valve as the common pressure conduit leading to a respective working pressure chamber, whereby in the first valve position of the shut-off valve, both central position control connections are connected to the return pressure conduit, in the second valve position of the shut-off valve, both central position control connections are shut off relative to the return pressure conduit, and the selector valve means are provided for the stroke central position for connecting both end position control connections synchronously to the pressure source.

2. The device according to claim 1, wherein the shut-off valve and the selector valve means for the stroke central position are configured to operatively interact such that both end position control connections are adapted to be synchronously connected to the pressure source when both central position control connections are connected to the return pressure conduit.

3. The device according to claim 1, wherein the shut-off valve and the selector valve means for the two end-of-stroke positions are configured to interact such that, when only one of the end position control connections is connected to the pressure source, both central position control connections are shut off relative to the return pressure conduit.

4. The device according to claim 1, wherein throttle resistances are operatively arranged between the end and central position control connections, and the shut-off valve and selector valve means.

5. The device according to claim 1, wherein stroke positions of the working piston have catches.

6. The device according to claim 1, wherein the selector valve means for the stroke positions of the working piston and the shut-off valve are operatively arranged in a 5/3-way valve, and a spring apparatus is arranged to select a central valve position for the central position of the working piston.

7. The device according to claim 6, wherein electromagnetic actuators are provided for actuating the 5/3-way valve into its two other valve positions by an auxiliary control force.

* * * * *